US007051536B1

(12) United States Patent
Cohen et al.

(10) Patent No.: US 7,051,536 B1
(45) Date of Patent: May 30, 2006

(54) THERMAL CYCLER WITH PROTECTION FROM ATMOSPHERIC MOISTURE

(75) Inventors: David A. Cohen, Dedham, MA (US); Sunand Banerji, Stoneham, MA (US); Michael J. Denninger, Belmont, MA (US)

(73) Assignee: Bio-Rad Laboratories, Inc., Hercules, CA (US)

( * ) Notice: Subject to any disclaimer, the term of this patent is extended or adjusted under 35 U.S.C. 154(b) by 0 days.

(21) Appl. No.: 10/987,931

(22) Filed: Nov. 12, 2004

(51) Int. Cl.
*F25B 21/02* (2006.01)

(52) U.S. Cl. ..... 62/3.3; 62/3.6; 62/259.1

(58) Field of Classification Search ..... 62/3.2, 62/3.3, 3.7, 259.1, 3.6
See application file for complete search history.

(56) References Cited

U.S. PATENT DOCUMENTS 4,627,242 A * 12/1986 Beitner ..... 62/3.6
4,683,195 A 7/1987 Mullis et al.
4,683,202 A 7/1987 Mullis
4,965,188 A 10/1990 Mullis et al.
5,075,216 A 12/1991 Innis et al.
5,156,004 A * 10/1992 Wu et al. ..... 62/3.1
5,498,392 A 3/1996 Wilding et al.
5,639,423 A 6/1997 Northrup et al.
5,720,923 A 2/1998 Haff et al.
5,721,136 A 2/1998 Finney et al.
5,849,208 A 12/1998 Hayes et al.
5,935,522 A 8/1999 Swerdlow et al.
6,004,512 A 12/1999 Titcomb et al.
6,312,929 B1 11/2001 McMillan
6,345,507 B1 * 2/2002 Gillen ..... 62/3.7
6,413,766 B1 7/2002 Landers et al.
6,430,934 B1 * 8/2002 Evans et al. ..... 62/3.2
6,432,695 B1 8/2002 Zou et al.
6,499,306 B1 * 12/2002 Gillen ..... 62/129
6,521,447 B1 2/2003 Zou et al.

* cited by examiner

*Primary Examiner*—Melvin Jones
(74) *Attorney, Agent, or Firm*—M. Henry Heines; Townsend and Townsend and Crew, LLP

(57) ABSTRACT

Localized temperature control in a thermal cycler is achieved by thermoelectric modules that are protected from exposure to atmospheric moisture by a pair of loop-shaped gaskets that seal off an enclosure formed by the sample block, the heat sink, and a support frame to which the components are secured. The heat sink is a block with a plurality of fins and is secured to the thermoelectric modules by one or more clamping bars that fit between the fins and are arranged to eliminate interference with the fin geometry and with the functional surface area of the fins. Electric leads are embedded in a molded retainer element, each lead being in the shape of a "U" with two exposed legs joined by a bar at one end, one of the leads extending into the region sealed from the atmosphere and the other extending outside the region.

10 Claims, 3 Drawing Sheets

THERMAL CYCLER WITH PROTECTION FROM ATMOSPHERIC MOISTURE

BACKGROUND OF THE INVENTION

1. Field of the Invention

This invention resides in the field of laboratory apparatus for performing procedures that require simultaneous temperature control in a multitude of samples in a multi-receptacle sample block. In particular, this invention addresses concerns arising with the use of thermoelectric modules for temperature modulation and control.

2. Description of the Prior Art

The polymerase chain reaction (PCR) is one of many examples of chemical processes that require precise temperature control of reaction mixtures with rapid temperature changes between different stages of the procedure. PCR is a process for amplifying DNA, i.e., producing multiple copies of a DNA sequence from a single copy. PCR is typically performed in instruments that provide reagent transfer, temperature control, and optical detection in a multitude of reaction vessels such as wells, tubes, or capillaries. The process includes a sequence of stages that are temperature-sensitive, different stages being performed at different temperatures and the temperature being cycled through repeated temperature changes. In the typical PCR process, each sample is heated and cooled to three different target temperatures where the sample is maintained for a designated period of time. The first target temperature is about 95° C. which is the temperature required to separate double strands. This is followed by cooling to a target temperature of 55° C. for hybridization of the separated strands, and then heating to a target temperature of 72° C. for reactions involving the polymerase enzyme. The cycle is then repeated to achieve multiples of the product DNA, and the time consumed by each cycle can vary from a fraction of a minute to two minutes, depending on the equipment, the scale of the reaction, and the degree of automation. This thermal cycling is critical to the successful performance of the process, and is an important feature of any process that requires close control of temperature and a succession of stages at different temperatures. Many of these processes involve the simultaneous processing of large numbers of samples, each of a relatively small size, often on the microliter scale. In some cases, the procedure requires that certain samples maintained at one temperature while others are maintained at another. Laboratory equipment known as thermal cyclers have been developed to allow these procedures to be performed in an automated manner.

One of the methods for achieving temperature control over a multitude of samples in a thermal cycler or in any planar array, and also for placing segregated groups of samples at different temperatures, is by the use of thermoelectric modules. These modules are semi-conductor-based electronic components that function as small heat pumps through use of the Peltier effect, and can cause heat to flow in either direction, depending on the direction of current through the component. The many uses of thermoelectric modules include small laser diode coolers, portable refrigerators, and liquid coolers.

Thermoelectric modules are of particular interest in thermal cyclers in view of the localized temperature effect, electronic control, and rapid response that the modules offer. The modules are typically arranged edge-to-edge in a planar array to provide heating or cooling of a multitude of samples over a wide area, particularly when the samples are contained in a sample block, which is a unitary piece that has a flat undersurface and a number of wells or receptacles formed in its upper surface in a standardized geometrical arrangement. In the typical arrangement, the modules are placed under the sample block, and a heat sink, typically finned, is placed under the modules.

While the modules are highly effective and versatile, their efficiency can be compromised by a variety of factors in the construction of the cycler. The temperature changes can cause condensation on the module surfaces, for example, and the clamping apparatus that assures that the components are in full thermal contact can interfere with the heat sink fins. These and other concerns are addressed by the present invention.

SUMMARY OF THE INVENTION

In accordance with the present invention, the thermoelectric modules in a thermal cycler are placed inside an enclosure that is formed by the sample block, the heat sink and a support frame, and that is sealed against the intrusion of atmospheric moisture by gaskets, one of which is compressed between the sample block and the support frame and the other between the heat sink and the support frame. The gaskets allow for rapid assembly of the components and do not require manual positioning or alignment. Sealing can be achieved by simply placing the sample block, modules, and heat sink in the frame and securing these parts together.

This invention further resides in a construction for securement of a finned heat sink to the thermoelectric modules in a manner that does not compromise the fins of the heat sink in terms of the surface area of the fins or the access of the fins to air flowing past them. Securement is achieved by way of one or more clamping bars that are sufficiently thin to fit between the fins and of substantially smaller depth than the fins so that the most of the surface of each adjacent fin remains exposed. Preferably, the bars extend the full length of the adjacent fins, and most preferably, are in fact longer than the fins so that the ends of the bars will protrude beyond the fins to be secured to the remaining components of the assembly.

A still further innovation presented by this invention is a novel configuration of an electric lead in a molded part that serves as a partition dividing a region sealed against atmospheric exposure from a neighboring region. The electric lead has two legs joined at one end by a cross-bar to form a "U" shape. The cross-bar is embedded in the molded part and both legs are exposed and available for electrical connections, one leg extending into the sealed region and the other leg extending into the neighboring region. The "U" shape facilitates the molding of the part around the lead, and the part with the lead thus embedded is useful in any electronic device or instrument that contains electronic components that require an environment in which they are protected from exposure to atmospheric moisture. One such instrument is a thermal cycler, where one leg of the lead is electrically connected to the thermoelectric module inside the enclosure and the other leg is electrically connected to external electrical components such as a power supply, a controller, or any such component that feeds or regulates current to the module.

DETAILED DESCRIPTION OF THE INVENTION AND PREFERRED EMBODIMENTS

Each of the several different aspects of the present invention is susceptible to a wide range of variation in terms of the configurations of each component, the arrangements of the components in the assembly, the particular instrument or apparatus in which they are incorporated, and the function that the instrument is designed to perform. A detailed review of one particular embodiment however will provide an understanding of the function and operation of the invention in each of its many embodiments. The figures hereto depict a thermal cycler for a PCR instrument as one such embodiment.

Figure 1:
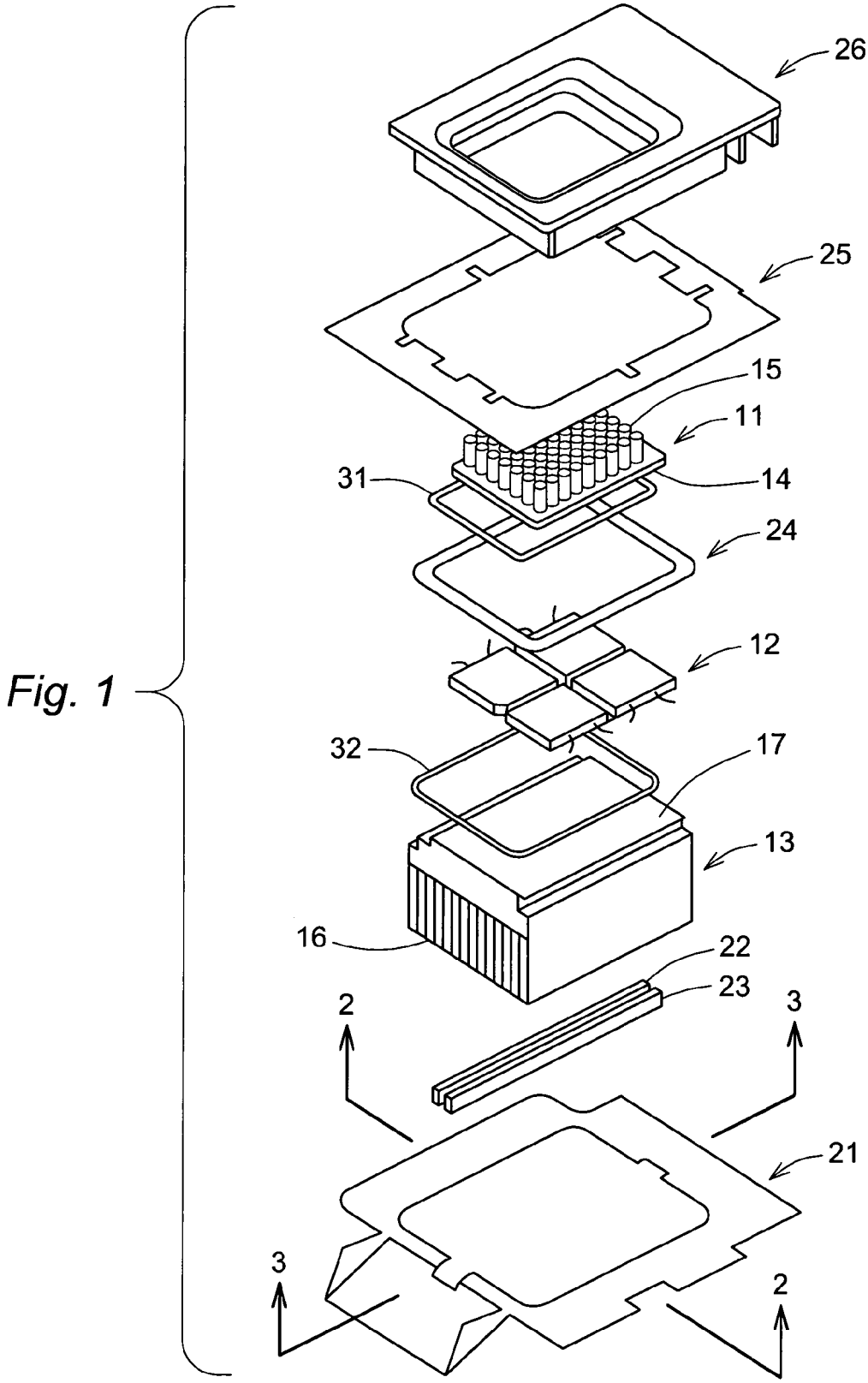
FIG. 1 is an exploded perspective view of a thermal cycler assembly in accordance with the present invention.

The components shown in the exploded perspective view of FIG. 1 include a sample block 11, thermoelectric modules 12, and a finned heat sink 13. These three components are shaped to allow them to be stacked in a configuration that places the broad faces on the upper and lower sides of the thermoelectric modules in thermal contact with the sample block and the heat sink, respectively. The terms "thermal contact" and "thermal interface" are used herein to indicate physical contact that allows free flow of thermal energy between two components along the entire area of contact of each component. The sample block 11 can be a unitary molded, cast, or machined component with a flat undersurface 14 and sample wells 15 on its upper side. The sample block shown has 48 sample wells arranged in a regularly spaced two-dimensional array. The thermoelectric modules 12 are beneath the sample block and in thermal contact with the undersurface 14 of the sample block. Four thermoelectric modules are shown. As in various other features of this invention, neither the number of sample wells nor the number of thermoelectric modules are critical, and each can vary widely. The heat sink 13 is positioned beneath the thermoelectric modules and includes a row of fins 16 extending away from the thermoelectric modules. On the upper surface of the heat sink is a thin layer 17 of heat conductive material to provide an enhanced thermal interface between the heat sink and the thermoelectric modules. The heat sink 13 is also referred to herein as a "heat sink block" since it is typically a unitary (single-piece) component.

The remaining components shown in FIG. 1 serve to secure the sample block, thermoelectric modules, and heat sink together, and to provide electrical connections for controlling the thermoelectric modules. These components are as follows:

- a mounting skirt 21 that joins the entire assembly to the remainder of the thermal cycler instrument of which the assembly itself is a component;
- a pair of clamping bars 22, 23 that fit between the fins 16 of the heat sink 13 to press the hear sink against the underside of the thermoelectric modules to achieve full thermal contact;
- an inner circuit board 24 that provides electrical connections directly to the thermoelectric modules;
- an outer circuit board 25 that provides electrical connections to components of the thermal cycler that are external to the assembly;
- a retainer element 26 that serves as a mount or support frame for the other components shown in the Figure, and that aligns the components and provides threaded bosses and other fastener connections that hold the components together;
- a loop-shaped gasket 31 to encircle the sample block 11 and seal the sample block against an inward-facing surface of the retainer element; and
- a second loop-shaped gasket 32 to encircle the heat sink 13 and seal the heat sink against another inward-facing surface of the retained element.

Components that are not shown in FIG. 1 include common fastening elements such as screws, washers, and the like that hold the parts together. The screws are received by threaded holes or bosses in the retainer element 26.

Figure 2:
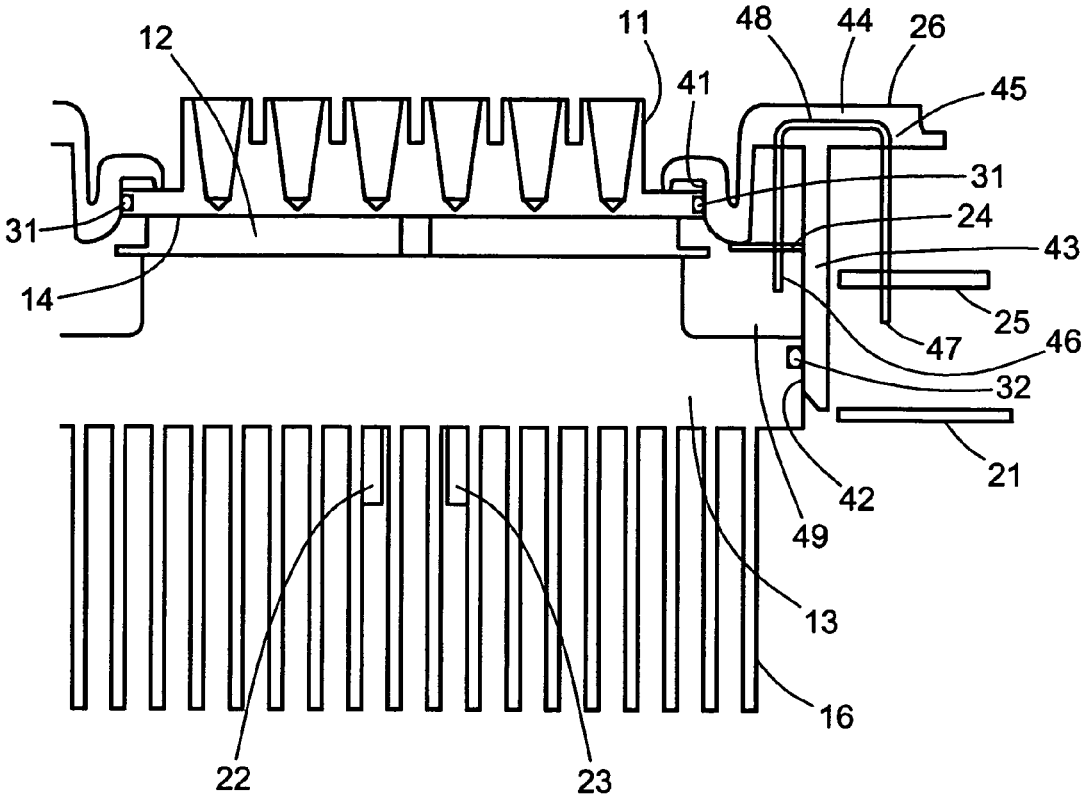
FIG. 2 is a cross section of the thermal cycler assembly of FIG. 1 in the plane indicated by the line 2—2 of FIG. 1.

The cross section of FIG. 2, whose orientation is indicated in FIG. 1 by the line 2—2 shows each of the parts of FIG. 1. The assembled parts form an enclosure around the thermoelectric modules 12, with the sample block 11 and a portion of the retainer element 26 forming the roof of the enclosure, the heat sink block 13 forming the floor of the enclosure, and other portions of the retainer element 26 forming the side walls. The smaller of the two loop-shaped gaskets 31 is lodged between the peripheral edge of the sample block 11 and a surface 41 along the interior opening of the retainer element 26, and the larger of the two loop-shaped gaskets 32 is lodged between the peripheral edge of the heat sink block 13 and a different surface 42 along the interior opening of the retainer element 26. In the embodiment shown, the gaskets each reside in a groove along the peripheral edge of the sample block and the heat sink block, respectively, and when these parts are inside the retainer element 26, both gaskets contact flat surfaces on the interior of the retainer element. The two gaskets seal the enclosure and protect the thermoelectric modules from exposure to regions outside (i.e., above, below, or lateral to) the retainer element 26, as well as regions above the sample block 11 and regions below the heat sink block 13. As a whole, the enclosure protects the thermoelectric modules from exposure to atmospheric moisture.

Also visible in FIG. 2 are the clamping bars 22, 23. The width of each bar is smaller than the gap between adjacent fins 16, thereby allowing each bar to fit easily between the fins. The depth of each bar is likewise less than the depth of each fin, thereby producing minimal interference with the exposure of the fin surface to air or any flowing coolant medium that might be used to dissipate the heat from the fins. In preferred constructions, each bar has two raised sections on its upper edge at locations inward from the ends of the bars. These raised sections contact the underside of the heat sink, thereby allowing greater contact of the heat sink with air, better control of the pressure exerted on the thermoelectric modules, and minimization of the stresses in the bars.

The profile of the retainer element 26 has a section that is T-shaped with a vertical section 43 and a horizontal section 44 at one end of the vertical section. The vertical section 43 serves as a partition that separates the sealed enclosure from the external regions. The horizontal section 44 serves as a mounting surface for the fastening screws referred to above (shown only in FIG. 3 and discussed below), with threaded holes and bosses (also shown in FIG. 3).

Also shown in FIG. 2 is an electrical lead 45 that joins the inner circuit board 24 with the outer circuit board 25. The lead is U-shaped with two legs 46, 47 joined by a cross-bar 48. The two legs are connected to the inner and outer circuit boards, respectively, while the cross-bar is embedded in the retaining element. As noted above, the U-shaped lead has applications in instruments in general that require the sealing of internal components in an interior region of the instrument from the environment or from other portions of the instrument. In all such applications, the lead is partially embedded in the molded part, with the cross-bar section of the lead fully embedded and the two legs exposed to allow them to be used for electrical connections. The lead can be embedded in any molded housing that serves as a partition between sealed and unsealed regions. In the embodiment shown in FIG. 2, the enclosure referred to above is formed by a gap 49 between the thermoelectric elements 12 and the retainer element wall 43. The inner exposed leg of the electric lead extends into this gap.

Figure 3:
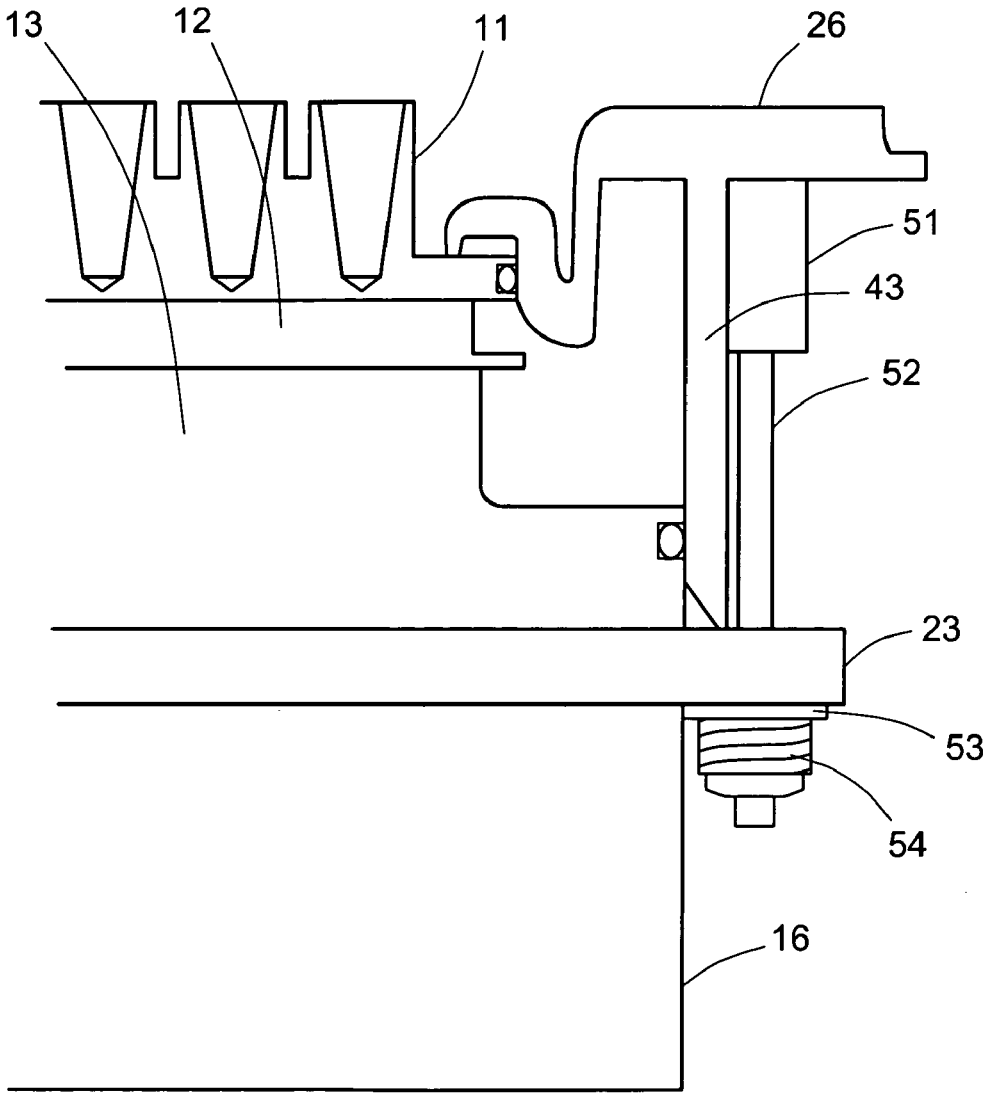
FIG. 3 is a cross section of the thermal cycler assembly of FIG. 1 in the plane indicated by the line 3—3 of FIG. 1.

The orientation of the cross section of FIG. 3 is indicated in FIG. 1 by the line 3—3 and is transverse to the orientation of the cross section of FIG. 2. FIG. 3 shows each of the parts of FIG. 1 except the skirt 21 and the inner and outer circuit boards 24, 25. In addition to the parts that are also shown in FIG. 1, FIG. 3 shows the fastener components that engage the clamping bars 22, 23 and secure together the sample block 11, thermoelectric modules 14, and heat sink block 13. By virtue of the orientation of the cross section, FIG. 3 shows a broad surface of one fin 16 and the broad surface of one clamping bar 23. The fastener is a spring-loaded fastener, and its components include a boss 51 on the undersurface of the retainer element 26, a bolt 52, a flat washer 53, and several spring washers 54. The boss 51 is internally threaded to mate with threads on the bolt. The bolt 52 fits between the two clamping bars, and the flat washer 53 is wide enough to contact both bars and press the bars against the heat sink block. Both bars are thus engaged by the single fastener. The spring washers 54 are shown in a compressed condition, and their effect is to apply pressure to the clamping bars in a manner that is consistent and reproducible.

While the Figure shows only the bolt, washers, and threaded boss at one end of the clamping bars, an identical bolt, washers and threaded boss exist at the other end in a symmetrical arrangement with those that are shown.

The components used in the practice of this invention can be components that were in existence at the time of filing of this application, including those that are readily available from suppliers. The thermoelectric modules, which are also known as Peltier devices, are units widely used as components in laboratory instrumentation and equipment, well known among those familiar with such equipment, and readily available from commercial suppliers of electrical components. Thermoelectric modules are small solid-state devices that function as heat pumps, operating under the theory that when electric current flows through two dissimilar conductors, the junction of the two conductors will either absorb or release heat depending on the direction of current flow. The typical thermoelectric module consists of two ceramic or metallic plates separated by a semiconductor material, of which a common example is bismuth telluride. In addition to the electric current, the direction of heat transport can further be determined by the nature of the charge carrier in the semiconductor (i.e., N-type vs. P-type). Thermoelectric modules can thus be arranged and/or electrically connected in the apparatus of the present invention to heat or to cool the sample block or portions of the sample block. A single thermoelectric module can be as thin as a few millimeters with surface dimensions of a few centimeters square, although both smaller and larger thermoelectric modules exist and can be used. A single thermoelectric module can be used, or two or more thermoelectric modules can be grouped together to control the temperature of a region of the sample block whose lateral dimensions exceed those of a single module. Adjacent thermoelectric modules can also be controlled to produce different rates or directions of heat flow, thereby placing different samples or groups of samples at different temperatures.

Further variations are also within the scope of the invention. The loop-shaped gaskets, for example, are shown as different sizes but the shapes of the components can be adjusted or varied to permit the use of gaskets of the same size. The construction shown in the Figures contains two clamping bars, but effective securement can also be achieved with a single clamping bar or with three or more clamping bars. As shown, the clamping bars are greater in length than the fins, and extend beyond the fins in both directions, leaving the ends of the bars accessible for securement to the retainer element. Alternatively, the bars can be equal to or less than the length of each fin, or secured to the retainer element at only one end rather than at both ends. A further alternative is the use of pairs of bars that extend to less than half the distance toward the fin centers, with one bar of each pair entering the fin area from one end of the fin array and the other from the other end. A still further alternative is the use of a pair of bars that are joined at both ends to form a loop to encircle a fin or two or more fins. The spacing between the clamping bars can also vary. In the embodiment shown, the bars are spaced such that only one fin passes between them. Alternatively, the spacing can be increased to allow two or more fins pass between the bars. The heat sink shown in the Figures contains fifteen fins, but this number can vary widely, from as few as three or four to as many as fifty or more. A preferred range is six to twenty. Furthermore, alternatives to the threaded bolts, such as clips or cams, can also be used and will be readily apparent to those skilled in the art.

The materials of construction will preferably be selected to allow each component to serve its function in an optimal manner. Components that are in contact with the samples, for example, will be fabricated from inert materials, such as polycarbonate or other plastics, and sample blocks and heat sinks that respond rapidly to changes in the heat transfer rate induced by the thermoelectric modules can be obtained by the use of thin materials or materials that conduct heat readily. Still further variations will be readily apparent to those skilled in the art of laboratory equipment design, construction, and use.

What is claimed is:

1. Apparatus for controlling temperature in a plurality of samples, said apparatus comprising:

a multi-receptacle sample block, a thermoelectric module, and a heat sink block, all shaped to be capable of arrangement in a stacked configuration in which said sample block is in thermal contact with said thermoelectric module and said thermoelectric module is in thermal contact with said heat sink block, a support frame sized to receive said sample block, said thermoelectric module, and said heat sink block in said stacked configuration, a first loop-shaped gasket sized to encircle said sample block along a peripheral surface thereof and thereby form a seal between said sample block and said support frame, and a second loop-shaped gasket sized to encircle said heat sink block along a peripheral surface thereof and thereby form a seal between said heat sink block and said support frame, said sample block, said heat sink block, said support frame, and said loop-shaped gaskets thereby together forming a sealed enclosure surrounding said thermoelectric module and protecting said thermoelectric module from atmospheric moisture.

2. The apparatus of claim 1 further comprising a first groove in said peripheral surface of said sample block to receive said first loop-shaped gasket and a second groove in said peripheral surface of said heat sink block to receive said second loop-shaped gasket, and wherein said support frame has flat surfaces where said support frame contacts said first and second loop-shaped gaskets.

3. The apparatus of claim 1 comprising a plurality of thermoelectric modules arranged edge to edge in a planar array, and wherein in said stacked configuration said sample block is in thermal contact with said planar array, and said planar array is in thermal contact with said heat sink block.

4. The apparatus of claim 1 wherein said sealed enclosure defines a gap between edges of said thermoelectric module and said support frame.

5. The apparatus of claim 1 wherein said support frame is a unitary molded piece with electric leads partially embedded therein.

6. The apparatus of claim 5 wherein said sealed enclosure defines a gap between edges of said thermoelectric module and said support frame and said electric leads have exposed ends extending into said gap.

7. The apparatus of claim 5 wherein each electric lead consists of first and second legs joined by a cross-bar in a U-shape, said cross-bar embedded in said molded piece and said first and second legs exposed, said first leg extending inside said sealed enclosure and said second leg extending outside said sealed enclosure.

8. A molded housing for an electronic instrument, said housing comprising a sealed enclosure comprising:

a molded partition separating an interior from atmospheric exposure, and a U-shaped electric lead defined by first and second legs joined by an end cross-bar, said end cross-bar embedded in said partition with said first leg extending to one side of said partition and said second leg extending to another side of said partition.

9. Apparatus for controlling temperature in a plurality of samples, said apparatus comprising:

a multi-receptacle sample block, a thermoelectric module, and a finned heat sink block, all shaped to be capable of arrangement in a stacked configuration in which said sample block is in thermal contact with said thermoelectric module and said thermoelectric module is in thermal contact with said heat sink block, a support frame sized to receive said sample block, said thermoelectric module, and said finned heat sink block in said stacked configuration, and a bar greater in length than said fins of said finned heat sink block and sized to fit between adjacent fins of said finned heat sink block, and spring-loaded fasteners affixing said bar to said support frame to secure said finned heat sink block against said thermoelectric module when in said stacked configuration, one such fastener at each end of said bar.

10. Apparatus for controlling temperature in a plurality of samples, said apparatus comprising:

a multi-receptacle sample block, a thermoelectric module, and a finned heat sink block, all shaped to be capable of arrangement in a stacked configuration in which said sample block is in thermal contact with said thermoelectric module and said thermoelectric module is in thermal contact with said heat sink block, a support frame sized to receive said sample block, said thermoelectric module, and said finned heat sink block in said stacked configuration, and exactly two bars sized to fit between adjacent fins of said finned heat sink block, and a pair of spring-loaded fasteners positioned on opposing ends of said fins, each said fastener engaging both bars.

* * * * *